US007267072B2

(12) United States Patent
Zhang

(10) Patent No.: US 7,267,072 B2
(45) Date of Patent: Sep. 11, 2007

(54) DRY CARGO SUBMARINE WITH AIR-CHARGE CARGO HOLD

(76) Inventor: Mao Zhang, 5578 Spur Ct., Fontana, CA (US) 92336

( * ) Notice: Subject to any disclaimer, the term of this patent is extended or adjusted under 35 U.S.C. 154(b) by 0 days.

(21) Appl. No.: 10/208,799

(22) Filed: Aug. 1, 2002

(65) Prior Publication Data

US 2004/0103837 A1 Jun. 3, 2004

(51) Int. Cl.
*B63G 8/00* (2006.01)
*B63B 25/02* (2006.01)
*B63B 25/04* (2006.01)

(52) U.S. Cl. ..... 114/312; 114/73; 114/321

(58) Field of Classification Search ..... 114/257, 114/312, 334, 335, 321, 256, 73, 72–74 A; 405/193

See application file for complete search history.

(56) References Cited

U.S. PATENT DOCUMENTS 1,115,367 A * 10/1914 Aanstoots ..... 114/334
1,131,712 A * 3/1915 Klein ..... 114/312
3,396,762 A * 8/1968 Paton ..... 141/7
3,561,387 A * 2/1971 Kumm et al. ..... 114/322
3,834,337 A * 9/1974 Bremaud ..... 114/321
3,903,825 A * 9/1975 Hamy ..... 114/77 R
3,975,167 A * 8/1976 Nierman ..... 114/321
4,903,628 A * 2/1990 Lansford ..... 114/312
5,144,905 A * 9/1992 Tanaka ..... 114/333
6,401,487 B1 * 6/2002 Kotliar ..... 62/640

FOREIGN PATENT DOCUMENTS

RU 2114024 C1 * 6/1998

* cited by examiner

*Primary Examiner*—Ajay Vasudeva

(57) ABSTRACT

Submarines with air-charged cargo holds are provided. The pressurize hull of a traditional submarine's cargo hold is replaced by non-pressurized hull, which lowers costs for transporting dry cargo and solves strength and seal problems raised when providing large openings for hatches. The dive depth of the air-charged cargo submarines is not large, so the pressure and volume of the charged air in the cargo hold are limited. This allows problems associated with ensuring the safety of the crew and properly operating the submarine to be easily solved.

7 Claims, 1 Drawing Sheet

A–A

B–B node1

DRY CARGO SUBMARINE WITH AIR-CHARGE CARGO HOLD

BACKGROUND OF THE INVENTION

In the latter part of World War II, Germany used submarines to transport military cargo and began to design underwater cargo ships for carrying dry cargo.

More recently, research has been performed on underwater vessels using nuclear power. In particular, researchers have investigated the possibility of constructing underwater oil tankers, underwater vessels for carrying minerals and sand, and other underwater dry cargo vessels for carrying 20–50 thousand tons of cargo. Underwater vessels may be attractive in military applications and can sail under ice. Certain voyages can be shortened greatly by passing through the arctic seas. Hidden transportation can be advantageous during times of war. Nuclear-powered high speed underwater oil tankers may have certain advantages over normal oil tankers operating at comparable speeds and with comparable cargo weights during storms.

Underwater oil tankers are also attractive because their holds are full of liquid oil, which cannot be compressed. Because the internal and external pressures on the hold stay equal at various depths under water, unpressurized holds may be used. The loading of this type of vessel can be 30% greater than a vessel of the same tonnage using a pressurized hold. There is also no need to use lifting equipment when loading and unloading oil. Oil can be removed through a small hole in the vessel's hull. It is easy to create this type of small hole using modern submarine technology. To date, there are essentially no viable underwater dry cargo transportation vessels available.

SUMMARY OF THE INVENTION

The present invention relates to charging the cargo hold space of an underwater transportation vessel with air. This allows the vessel to withstand external water pressure. It also changes the direction of net pressure on the hull of the hold from external pressure to internal pressure.

With this type of pressure on the hull, it is possible to avoid hull instabilities. This allows the hull of the vessel's cargo hold to use a non-pressurized arrangement. Using a non-pressurized hull overcomes strength and seal problems that are raised by providing large hatches under water. Moreover, this type of arrangement is efficient in reducing hull weight and increasing cargo payload. This helps to overcome potential problems when loading large military equipment and cargo and reduces the cost of transportation.

In accordance with the present invention, various new types of air-charged cargo submarines (ACS) are provided. These submarines can carry tanks, missiles, aircraft, divers, torpedoes, dry cargo, bulk cargo, containers, mine laying equipment, supplies for submarines, serving as an oil and gas drilling vessels, supplies for warehouses, etc.

The dive depth of the air-charged submarine of the present invention is not large. The pressure and volume of the charged air are limited. This allows problems related to safety, equipment, and technology to be easily solved.

Figure 1:
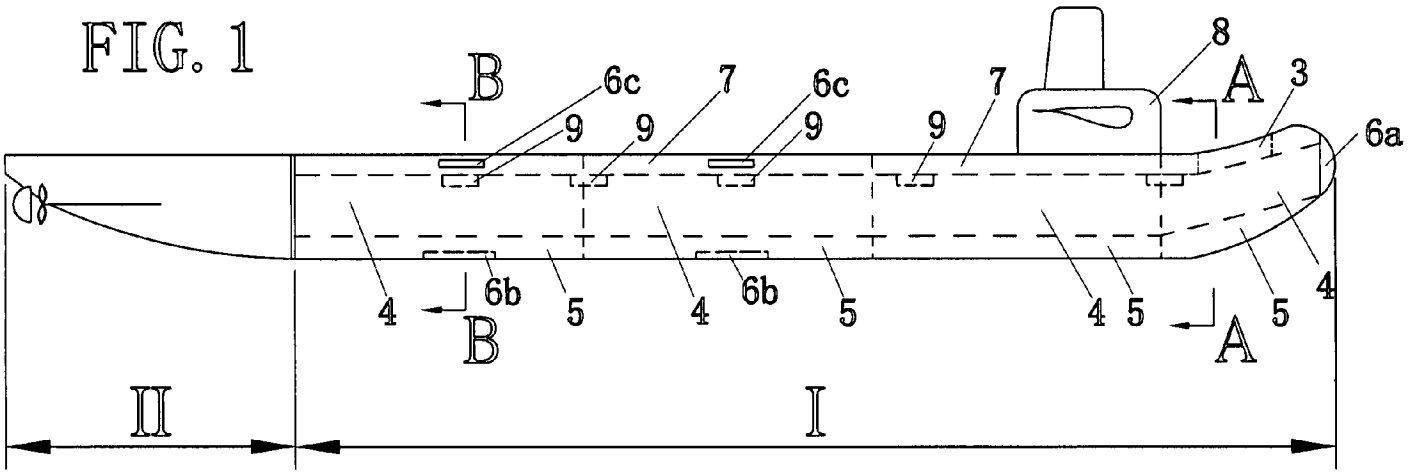
FIG. 1, is a schematic longitudinal view of the "Dry cargo submarine with air-charged cargo hold."

There are two parts in FIG. 1: Part I and part II,

Part I, Most of the holds are non-pressure-resistant structural single metal hull including the air-charged dry cargo holds 4 and the water hold 5, except a few of pressurized structure crew cabins, including crew corridors cabin 7, command cabin 8, pressure-transition cabins 9 and high-pressure air source storing and control cabin 3.

The hatch 6*a*, 6*b* and 6*c* will be opened on the head, at the bottom and by the upside of the submarine respectively for loading and unloading the dry cargo from the dry cargo holds 4.

Part II, All of them are crew cabins made by the normal submarine's pressurized structure with double metal hulls for crew living and working there.

Figure 2:
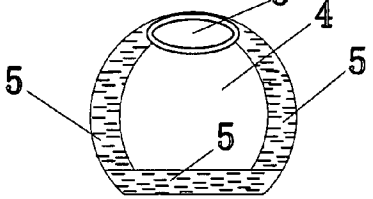
Figure 3:
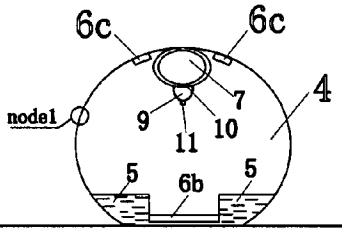
Figure 4:
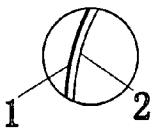

FIG. 2, The cross section view on A—A site of FIG. 1,

FIG. 3, The cross section view on B—B site of FIG. 1,

FIG. 4, An enlarged cross section view of node 1 on the hull of the air-charged hold 4 indicating on FIG. 3. The hull 1 is a non-pressure-resistant metal structure with single hull; the interlayer 2 is an anti-air-leak membrane as an internal wall of the dry cargo hold to prevent air leaking from the cargo hold.

DETAILED DESCRIPTION OF THE INVENTION

Principle Characteristics of Air-Charged Cargo Submarines

The hold of an air-charged dry cargo submarine in accordance with the present invention is charged with air. This maintains the internal and external pressure on the hold at the same level (or at only a small pressure difference between the two) when the submarine is under water. Internal air pressure is balanced with external water pressure, just as internal oil can support external water in underwater oil tankers. The ability of the pressure of the charged air in the hold of the air-charged cargo submarines of the present invention to balance external water pressure is sometimes referred to herein as the "air supporting pressure principle" (ASPP).

Principle characteristics of air-charged cargo submarines that result from application of the "air supporting pressure principle" include the following:

1) Large hull sizes may be used that are light and thin and non-pressurized, similar to those of underwater oil tankers. This can greatly reduce the weight of the hull. Compressed air is dry and has hardly any weight and it only occupies the space remaining after the submarine's cargo has been loaded, so the payload coefficient increase greatly.

2) Because the internal pressure on the hull is the same as the external pressure on the hull, the hull need not be a pressure-resistant double hull. Rather a non-pressure-resistant single hull may be used. It is therefore possible to provide a large hatch in the hull. This allows large pieces of military equipment and other cargo to be easily loaded into the submarine through the hatch. A large hatch can be provided on the submarine. There are three kinds of hatch 6*a*, 6*b* and 6*c* (see FIG. 1 and FIG. 3) for loading and unloading the dry cargo from the dry cargo holds:

Hatch 6*a* is at the head of the submarine for loading and unloading of motor-driven vehicles and equipment from the cargo hold 4 while the submarine is on the water surface, such as tanks, aircrafts etc.

Hatch 6*b* is at the bottom of the submarine for carrying some specific equipment or serving some particular tasks underwater, such as carrying divers, serving as a mothership for other submarines, as an underwater minelayer, or as an underwater exploration ship etc.

This type of hatch can be opened without allowing water to enter the interior of the hold, can realize hidden work underwater and will not be disturbed by storms.

Hatch 6*c* is at the upside of the submarine for loading and unloading of dry cargo or equipment from dry cargo hold 4 while the submarine is on the water surface.

3) Although the internal pressure and external pressure on the submarine's hold are typically equal, the internal pressure on the hold can be made larger than the external pressure if desired. This type of arrangement avoids instabilities that might otherwise develop in the event that the hull is subjected to external pressures, Accordingly, hull strength can be improved, particularly thin-hulled holds having large spans.

4) After air charging the hold, the hold is resistant to water leakage. The pressurized air in the hold greatly slows down water entering the hold if the hold is damaged. If damage occurs at the bottom of the hull, water will not enter the hold regardless of the extent of the damage. An anti-leak membrane can be used to prevent outward air leakage in the event of damage to a portion of the submarine where the internal air pressure is larger than external water pressure on the hold.

FIG. 4 shows an enlarged cross section view on node 1 of the hull of the air-charged hold 4 indicating on FIG. 3. The hull 1 is a non-pressure-resistant metal structure with single hull; The interlayer 2 is an anti-air-leak membrane as an internal wall of the dry cargo hold 4 to prevent air leaking from the cargo hold.

Air-Charging Techniques and Equipment for Air-Charged Cargo Submarines

The body of the air-charged dry cargo hold is a steel or other metal single hull structure with an interlayer of anti-leak membrane (see FIG. 4). The pressure of the charged air depends on the depth of dive. The air pressure that is required increases with increasing depth, which poses challenges to equipment and safety. It does not make sense to use the air-charged cargo submarine arrangement of the present invention if the depth is too small. There is therefore a need to select a suitable depth. Techniques for air-charging the submarine may be classified as follows:

1) Air-Charge Once on Water Surface

With this approach, cargo is loaded and the hold is closed while the air-charged cargo submarine is on the surface of the ocean. Air is forced into the hold using an air compressor or high pressure air cylinder. The air pressure should be as large as the water pressure that is to be encountered at the expected dive depth. The internal air pressure will be maintained at the same level while sailing. Differences between the internal and external pressure that arises from changes in depth can be accommodated by the hull. The internal pressure must be supported by the hull while the air-charged cargo submarine is on the sea surface.

This technique is simple and allows the air-charged cargo submarine to go up and down easily within a prescribed depth range. However, this technique is only suitable for a small depth range. In general, the ideal depth range is 25–50 m. With this approach, a dive depth of 40 m is sufficient for normal operation of the air-charged cargo submarine. This depth allows the air-charged cargo submarine to avoid disturbances from the ocean surface and allows for hidden transportation of cargo. Moreover, the steel hull of the hold can easily sustain 5 atm (atmospheric pressure) of internal pressure.

Typically only an additional 4 atm must be charged into the hold to support dive depths up to 40 m. This pressure is smaller than that of an automobile tire and allows people can enter the hold without using a special breathing apparatus. The oxygen pressure is low in this type of environment so it is easy to prevent air from burning. The hull can resist a certain amount of external pressure (such as 4 atm), so the depth of a dive can also be over 40 m (i.e., up to 80 m). For normal operation of an air-charged cargo submarine, 40 m is a suitable dive depth and allows use of the simple "air-charge once on water surface" technique.

2) Gradually Air-Charge Under Water

With this approach, the hold of the air-charged cargo submarine is gradually charged with air as the dive depth increases. This method is used only for large dive depths and large hatches.

3) Hybrid Charging

This approach is a combination of the "air-charge once on water surface" and "air-charge under water" techniques.

The hold of the submarine is first charged with air on the water surface. The submarine then dives. Gradually, as the submarine dives, additional air is forced into the hold. When the submarine is on the surface, the hold can be charged with air from an air compressor or high pressure air cylinder on shore. The submarine can use an air-charge valve on the hull of the hold. Air may then be directly charged into the hold through a pipe.

To support air-charging and air-exhausting for dry cargo hold 4 and pressure-transition cabin 9, a storing and control cabin 3 for high-pressure air source such as the high-air-pressure cylinder and compressor are installed in the cabin 3. The pressure in a high-air-pressure cylinder can reach 200–300 atm, so holds without high air-charge pressures can easily accommodate the suitable air cylinders despite space and weight considerations. To maintain a suitable air pressure in the hold, the process of charging air into the hold and removing air from the hold can be controlled automatically using a pressure control system including varied pressure sensors, valves, meters, monitors and pipes in the cabin 3. Conventional submarines have air compression systems that are used primarily for blowing water out of the hold and for supporting damaged holds. The equipment used in such air compression systems can be used for the air-charging operations of the air-charged cargo submarine of the present invention.

The Structure, Power Equipment and General Layout of Air-Charged Cargo Submarines 1) Structure Steel or other metal structures may be used for the entire hull of the air-charged cargo submarine. Pressurized structures can be provided for human habitation and to house power and control equipment. In these pressurized structures, the air pressure for crew living and working areas may always be maintained at 1 atmosphere. Non-pressure-resistant structures can be used for the cargo hold and a water hold. The cargo hold of a submarine occupies most of the volume of the submarine. Hold volumes increase as cargo loading increases, which further favors the use of an air-charged cargo submarine. It has been reported that an underwater nuclear-powered oil tanker with a non-pressure-resistant hold could support an increase of 30% in loading while reducing production costs by 50% compared to an underwater oil tanker with a pressurized hold of the same tonnage. The hull weight for such an underwater oil tanker is expected to be smaller than a surface ship with the same loading. Non-pressure-resistant structures in accordance with the present invention can have the same advantage.

2) Power

Two types of power can be used to power the air-charged cargo submarine: diesel-engine/electrical power and nuclear power. An air-charged cargo submarine with diesel-engine/ electrical power must charge its batteries on the ocean surface, so the dive depth should not be large. The amount of charged air pressure that is used in this situation is therefore not large. The hull of the hold supports an internal pressure while on the sea surface. The submarine can travel up and down within a designed depth range. For an air-charged cargo submarine powered with nuclear power, there is no depth limitation due to the power system.

3) General Layout

As see in FIG. 1, it is a schematic longitudinal view of the "Dry cargo submarine with air-charged cargo hold."

There are two parts in FIG. 1: Part I and part II,

Part I, Most of the holds are non-pressure-resistant structural single metal hull including the air-charged dry cargo holds 4 and the water hold 5, except a few of pressurized structure crew cabins, including crew corridors cabin 7, command cabin 8, pressure-transition cabins 9 and high-pressure air source storing and control cabin 3.

Part II, All of them are crew cabins made by the normal submarine's pressurized structure with double metal hulls for crew living and working there.

FIG. 2, The cross section view on A—A site of FIG. 1,

FIG. 3, The cross section view on B—B site of FIG. 1,

The non-pressurized hull structure includes the air-charged dry cargo hold 4 and water hold 5. These structures occupy most of the air-charged cargo submarine. The remainder of the submarine is made up of crew cabins for personnel, power equipment, control equipment, command, corridors, and pressure transitions. The crew live and work in the crew cabins, so the crew cabins should be maintained at 1 atmosphere of pressure using pressure-resistant cabin structures. Such structures are typically in the rear portion II of the air-charged submarine. Crew corridors 7 for personnel connect the command cabin with other crew cabins. Observation windows may be provided in the crew corridors that face the cargo hold 4 and pressure-transition cabin 9 for monitoring and maintenance procedures. The pressure-transition cabin 9 is between the dry cargo hold 4 and the crew corridors cabins 7. The air pressure of the pressure-transition cabin 9 can be changed to allow crew to transfer in and out of the cargo hold through the gate 10 and gate 11 (see FIG. 3). Important pipes, communication lines and electrical lines may be located in the corridors for maintenance and servicing. The hold gate can located on the submarine's head or at the bottom of the submarine, which may be particularly advantageous when it is desired to load large equipment, such as tanks, vessels, missiles, aircraft, divers, torpedoes, mines, and other equipment.

The Safety of Air-Charged Cargo Holds

1) Safely Charging and Exhausting Air and Preventing Leakage

When charging air into the hold on the sea surface, air should be prevented from leaking. When gradually charging air into the hold under water, automatic sensor control valves should be used to add pressure or reduce pressure by exhausting air out of hold. For water depths of over 100 meters, oxygen pressure can increase due to the pressure of the compressed air in the hold. There is therefore a need to introduce a gas other than oxygen to prevent the cargo hold from burning. Suitable non-oxygen gases include non-oxygenated air, nitrogen, and $CO_2$. In this type of environment, personnel in the submarine must wear masks while in cargo hold.

The air-charged cargo hold is generally depressurized before unloading. The simplest method is to exhaust air out of hold under water or on the ocean surface. To prevent injury to personnel and damage to equipment, depressurization operations should be controlled so that air is not exhausted from locations other than the exhaust valve.

The air-charged cargo submarine should not allow air to leak from the hold under water, because this could reduce the strength of the hull in the vicinity of the leak and cause an accident or reveal the submarines concealed location during war. Underwater leaks usually take place at gaps in joints and other small holes while the internal pressure on the hold is larger than the external pressure (i.e., while sailing at small depths). Leaks can be prevented using an interlayer of anti-leak membrane on the internal wall of cargo hold and in the cargo gate. The anti-leak membrane functions like the inner tube of an automobile tire.

2) Monitoring System

The crew of the air-charged cargo submarine usually lives and works in a normal-pressure (1 atm) cabin rather than the high-pressure cargo hold. Accordingly, a monitoring system should be installed in the normal cabin to monitor the cargo hold. The monitoring system can be used to monitor for accidents caused from fire, water leaks, and air leaks in cargo hold. The monitoring system includes observation windows, sensors, closed-circuit television equipment and communication/command systems.

3) Fire Prevention

The air in the cargo hold is charged to a pressure of 4 additional atm when the air-charged cargo submarine sails at a depth of 40 meters. In this situation, the oxygen pressure in the cargo hold is lower than 1 atm. Although this oxygen pressure will not cause fires easily, it may be desirable to follow certain safety procedures for the air-charged cargo hold. Steps should be taken to prevent burning of cargo that can burn easily. Fire extinguishers can be provided both inside and outside of the cargo hold. If the cargo hold is pressurized with non-oxygenated air, fire is not a concern.

4) Cargo Requirements

All cargo must be able to sustain the pressure of the air in the air-charged cargo hold. This requirement is generally satisfied for regular dry and bulk cargo. Industrial and military equipment that have not passed pressure-resistant testing should be tested for pressure resistance. Steps should also be taken to prepare equipment for the cargo hold. Such steps may include adding a protective case to a non-pressure-resistant meter and filling the fuel tank for an engine with liquid.

Safety of the Crew

The crew live in a normally-pressurized (1 atm) cabin during a voyage and only enter the cargo hold when an accident occurs. Personnel will therefore face problems in entering the high pressure environment of the hold. Medical safety procedures used for scuba diving in high pressure can be employed when the crew enter and exit the cargo hold. The crew should complete diving training. With diving training, the crew can operate safely in the high pressure environment of the air-charged cargo hold. Diving decompression procedures can be followed when exiting the cargo hold. A pressure-transition cabin is located between the cabins that are at normal atmospheric pressure and the high-pressure air-charged cargo hold. People can generally enter a high pressure environment at a rate of 4 atm. per minute, so personnel can enter the high-pressure air-charged cargo hold rapidly from a cabin at 1 atm.

When the submarine is at a depth of 40 meters, the hold is charged with an additional 4 atm. The crew can safely remain in this environment for 24 hours breathing the air directly. This is sufficient time for personnel to handle trouble in the hold.

Personnel must be decompressed after leaving the cargo hold to prevent decompression sickness. Decompression takes place in the pressure-transition cabin. The decompression time depends on the amount of pressure in the cargo hold, the length of time the personnel was exposed to the high pressure, and the type of gas present in the cargo hold. It usually takes 10 to 20 minutes to handle trouble in the hold, so it only takes several minutes to complete decompression using rapid decompression techniques. To guarantee safety, personnel should strictly follow proper decompression procedures.

Air pressure in the cargo hold can be over 7 atm when the dive depth exceeds 60 meters. Personnel cannot breathe the compressed air in the hold when the pressure is this high, so breathing masks with a helium-oxygen or nitrogen-oxygen mix should be used. The decompression time will also be longer than when the cargo hold pressure is lower. Currently humans can breath in helium oxygen mixtures at up to 61 atm, which is equal to water pressure at 600 meter. Personnel can therefore operate in very high pressure environments.

What is claimed is:

1. A method for carrying cargo underwater in a submarine having a dry cargo hold, comprising the steps of:

loading the cargo into the dry cargo hold of the submarine;

pressurizing the dry cargo hold of the submarine with air, such that the air in the dry cargo hold has a pressure equal to or larger than external water pressure on the submarine;

wherein the dry cargo hold of the submarine has a non-pressure-resistant structural single metal hull with a hatch and wherein loading the cargo further comprises loading large cargo through the hatch;

providing an interlayer of anti-air-leak membrane on an internal wall of the dry cargo hold to prevent air from leaking from the submarine.

2. The method of claim 1, wherein pressurizing the dry cargo hold with air comprises using an air compressor or high pressure air cylinder to pressurize the dry cargo hold with air.

3. The method of claim 1, wherein pressurizing the dry cargo hold with air comprises:

pressurizing the dry cargo hold with air before the submarine dives; and gradually pressurizing the dry cargo hold with further air while the submarine dives.

4. The method of claim 1, wherein pressurizing the dry cargo hold with air comprises pressurizing the dry cargo hold with air while the submarine is at less than 100 m in depth, the method further comprising at least partly pressurizing the dry cargo hold with non-oxygen gases when the submarine is over 100 meters in depth to prevent the cargo in the dry cargo hold from burning.

5. The method of claim 1, wherein the submarine includes a crew cabin for crew and a pressure-transition cabin between the dry cargo hold and the crew cabin, the method further comprising adjusting air pressure in the pressure-transition cabin to allow the crew to enter and exit the dry cargo hold when an accident occurs in the dry cargo hold.

6. The method of claim 1, further comprising exhausting air out of the dry cargo hold underwater or on a sea surface to depressurize the dry cargo hold before unloading the cargo.

7. The method of claim 1, further comprising preparing the cargo to withstand pressure from the air in the dry cargo hold before loading the cargo in the dry cargo hold.

* * * * *